US008047969B1

(12) United States Patent
Jay

(10) Patent No.: US 8,047,969 B1
(45) Date of Patent: Nov. 1, 2011

(54) MOTION STILTS RETENTION SYSTEM

(76) Inventor: Jeffrey T. Jay, Las Vegas, NV (US)

( * ) Notice: Subject to any disclaimer, the term of this patent is extended or adjusted under 35 U.S.C. 154(b) by 0 days.

(21) Appl. No.: 12/249,848

(22) Filed: Oct. 10, 2008

Related U.S. Application Data

(60) Provisional application No. 60/979,038, filed on Oct. 10, 2007.

(51) Int. Cl.
*A63B 25/00* (2006.01)

(52) U.S. Cl. ..... 482/75

(58) Field of Classification Search ..... 482/75–77; 623/28
See application file for complete search history.

(56) References Cited

U.S. PATENT DOCUMENTS

| | | | | |
|---|---|---|---|---|
| 5,498,220 | A | 3/1996 | Ensmenger | |
| 5,514,054 | A | 5/1996 | Rowan | |
| 6,517,586 | B2 * | 2/2003 | Lin | 623/28 |
| 6,648,803 | B1 * | 11/2003 | Jay | 482/76 |
| 6,719,671 | B1 * | 4/2004 | Bock | 482/75 |
| 6,840,893 | B2 * | 1/2005 | Yoon | 482/77 |
| 7,258,652 | B2 * | 8/2007 | Florio et al. | 482/75 |
| 2005/0202940 | A1 * | 9/2005 | Simmons | 482/75 |

* cited by examiner

*Primary Examiner* — Fenn Mathew
(74) *Attorney, Agent, or Firm* — Kenehan & Lambertsen, Ltd.; John C. Lambertsen

(57) ABSTRACT

Motion or velocity stilts are provided a strapping system for attachment of the leg and foot of a user. An upper knee cuff uses dual straps that enwrap the leg and are secured by a front buckle and perimeter lengths of hook and loop fasteners. The hook and loop fasteners enable fore and aft leg positioning adjustments. The upper cuff is attached to the spring support utilizing a pair of knee braces that permit pivoting of the knee cuff as well as width adjustment for variation in user knee and leg diameters. The lower strapping system utilizes separate heel, instep, and toe straps to secure the foot to a foot plate.

15 Claims, 6 Drawing Sheets

MOTION STILTS RETENTION SYSTEM

RELATED APPLICATIONS

The present application claims priority under 35 USC §119 (e) to U.S. Provisional Patent Application Ser. No. 60/979,038, filed on Oct. 10, 2007, which is incorporated by reference herein.

BACKGROUND OF THE INVENTION

1. Field of the Invention

The present invention relates to spring or motion stilts, and, more particularly, to improved knee and foot retention systems thereon.

2. Description of the Related Art

The VELOCITY™ brand motion stilts are the supreme "performers" of inertia stilts. Motion stilts were originally designed with Military applications in mind. In a test for the United States Air Force in 2004, a quad was chased for ¼ of a mile at a sustained pace of 23 mph. A vertical jump of 10 feet was obtained with these motion stilts, which were specially-designed for the Air Force.

The VELOCITY™ brand motion stilts are for the serious stiltwalker acrobat. These motion stilts are adjustable in every direction, designed for multiple users, have removable, washable parts, tracking knee cuff for comfort and quick release buckles for quick in and out changes. The rubber footings durometer that is, the "grip" provided by the rubber footing, can be custom made to order, with options in the form of spikes for grass or ice and custom boot configurations. The VELOCITY™ brand motion stilts can generate up to 900 lb/sq. inch of pressure and weigh approximately 5.5 lbs (total).

Certain features provide additional advantages, specifically the split knee attachment and the foot/bottom strapping system.

DISCLOSURE OF THE INVENTION

The Split Knee Bow™ provides for enhanced adjustability—both forward and backward. If there is a preferred foot location or if there is a desired height that is extremely low, the soft cuff material can be easily modified and re-attached using the hook and loop fastening system, re-configuring the upper shin restraint so the person's leg will not touch the back of the top spring capture.

Adjustability is also provided for the preference in leg cuff width. If someone of a sizeable leg or, alternatively, a slender leg, needs a snug fit, only the Split Knee Bow™ retention system will allow the adjustability associated with this need. The bows can be adjusted inwards or outwards to obtain the perfect fit.

The Split Knee Bow™ cuff system also tracks the action of the leg by the use of mechanical grade Teflon® bushings and an axle system that locks it to the aluminum side bars Versatility is provided, where the top cuff has a Velcro® pad inside of laminated foam and is durable enough for removal and laundry. Also, where there are multiple users, each artist can have his or her own set of removable pads.

Bottom straps for adjustability have been designed to accommodate just about every size and style of shoe. The heel can be adjusted so that a small shoe can be moved forward for a safer strap and the upper cuff can be moved congruently to keep alignment. For a long shoe the heel can be moved all the way back and typically with the upper cuff. There is no left or right.

The artist will not have a solid knee bow, aluminum pipe, rubbing against the knee cap for discomfort or injury. The knee bow holds the leg tight and snug to avoid slipping around. The cuff tracks the legs movement still maintaining the division of the lateral force between the two bars. The quick-release buckles or 2-pass buckles allow the artist to remove the calf cuff almost instantly. Such quick release capabilities enable quick changes in costume, prompt removal if injury occurs or for similar situations and needs.

The custom footing comes in a custom-poured durometer, according to what is needed. Where required, a friction additive can be included in the poured material. Cleat bottoms allow for running and bouncing on grassy surfaces or on ice and areas not commonly safe for the normal rubber footing. The standard footing is a thinner 80 durometer rubber. Rollerblade options may also be used, and adapt to the footing to allow for inline skating with better leverage in the stroke.

In a further aspect of the present invention a motion stilt comprising: a spring support comprising: a central spring having a first terminus and a second terminus, a lower spring capture attached to said central spring at said first terminus, and an upper spring capture attached to said central spring at said second terminus; a knee cuff rotationally attached to said upper spring capture; and a foot plate having a heel and a toe end, said heel end of said foot plate attached to said upper spring capture and said toe end pivotally attached to said lower spring capture.

It is to be understood that the invention is not limited in its application to the details of construction and the arrangement of components described hereinafter and illustrated in the drawing figures. Those skilled in the art will recognize that various modifications can be made without departing from the scope of the invention.

DETAILED DESCRIPTION OF THE PREFERRED EMBODIMENTS

The leg strapping system is used to attach the leg and foot to the stilt. This strapping system utilizes military spec webbing and buckles. This system permits a user to quickly engage with and disengage from the stilts without compromising the integrity of the strapping system materials.

Figure 1:
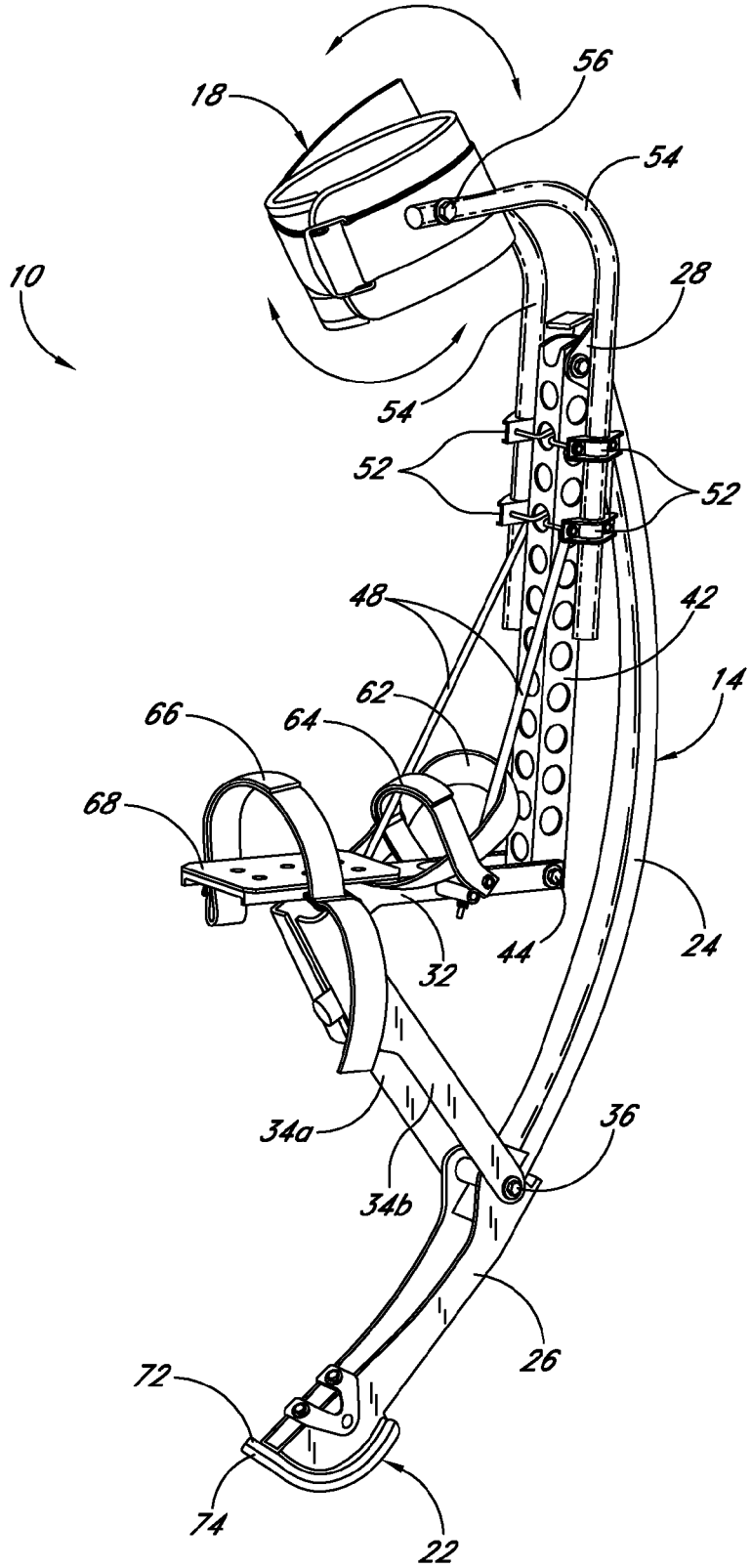
FIG. 1 is a perspective view of a motion stilt in accordance with the present invention.

Reference is now made to the drawings wherein like numerals refer to like parts throughout. In FIG. 1, a motion or spring stilt 10 is shown, having a spring support extending from a knee cuff 18 to a footing 22. The spring support 14 is a multi-component member consisting of a central spring 24 that extends between a lower spring capture 26 and an upper spring capture 28. The upper and lower spring captures 26, 28 are rigidly attached to the central spring 24 in a manner creating a solid member that efficiently transmits flexing loads to the footing 22 as the central spring 24 flexes in response to varying loads applied by a user (not shown in the drawings).

The knee cuff 18 and a foot plate 32 define the points of interconnection between the user and the motion stilts 10. A pair of rocker arms 34*a*, 34*b* connect the foot plate 32 to the lower spring capture 28, utilizing a rocker arm axle 36 to permit relative rotational motion therebetween as required by the flexure of the spring support 14.

A vertical upright 42 connects the rear of the foot plate 32 to the upper spring capture 28, with a vertical upright axle 44 at the connection with the foot plate 32 to permit relative rotational movement between the foot plate 32 and the vertical upright 42. A pair of leveling rods 48 are attached to and extend between an upper section of the vertical upright 42 and a mid-section of the foot plate 32, enabling adjustment of the foot plate 32 in a horizontal plane.

A plurality of leg brace brackets 52 are utilized to attach a pair of leg braces 54 to the vertical upright 42. The knee cuff 18 is rotatably attached to and supported by each of the pair of leg braces 54, utilizing a pair of knee cuff axle connectors 56 located on each side of the knee cuff 18.

A series of retention straps are used to releasably attach the foot of the user to the foot plate 32, including a heel strap 62, an instep strap 64, and a toe strap 66. A toe support plate 68 is attached to the forward section of the foot plate 32, providing a broader support surface for the user.

A footpad support 72 is formed on the bottom surface of the lower spring capture 26, and a variety of gripping surfaces 74 may be attached thereto—a flat pad is shown in FIG. 1; however, other options such as spikes for grass and ice, and specialized connectors such as for use with in-line skates are considered as encompassed by the present invention.

Figure 2:
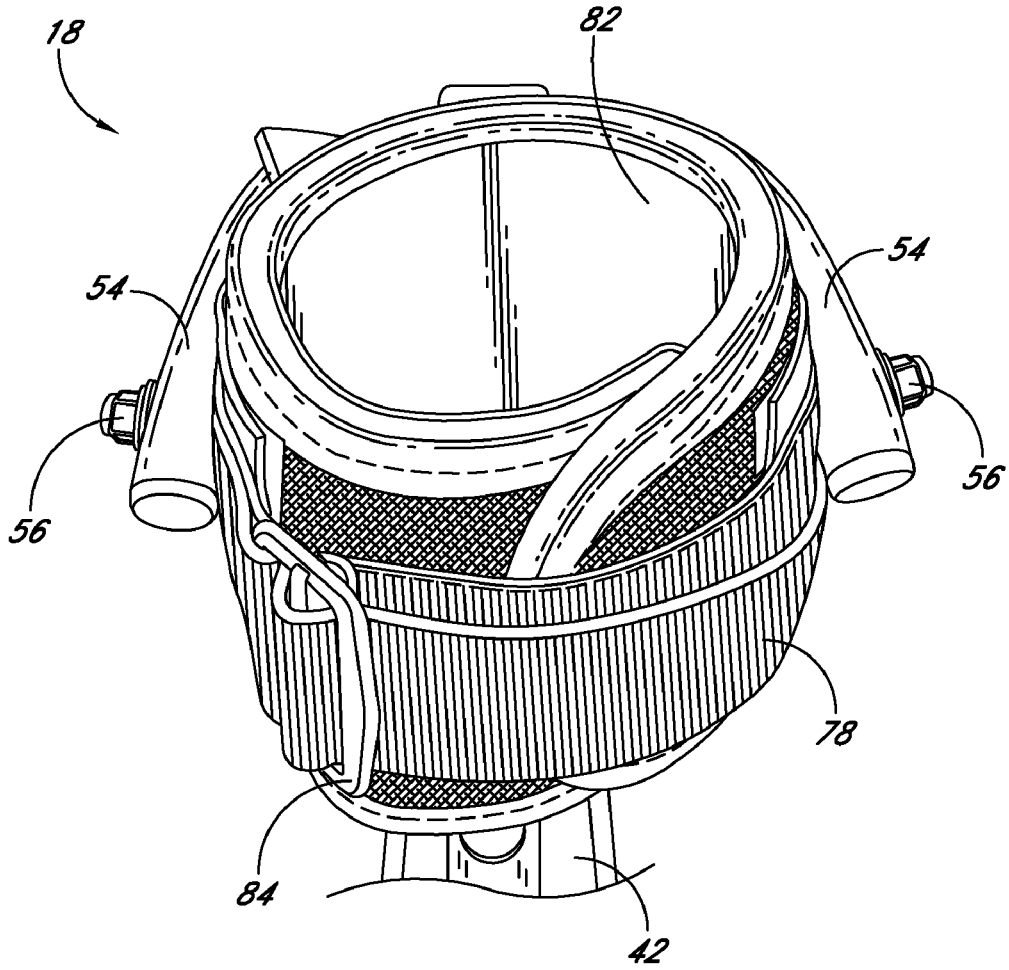
FIG. 2 is a partial perspective view of a split knee bow belt upper attachment system on a motion stilt in a closed configuration.

As is shown in FIG. 2, the upper knee cuff 18 is held together primarily by a pair of dual Velcro® straps 78 that are preferably four (4) inches wide in the rear for adjustability. Such adjustability permits a user to move his or her leg forward or backward within the stilt attachment location to achieve a desired lower leg and foot placement.

A cuff pad 82 is received within the leg-receiving opening defined by the dual straps 78, and is preferably held in place using hook and loop fasteners, such as one surface formed on the inside surface of the dual straps 78 and a complementary surface formed on the outer surface of the cuff pad 82. Including a laminated foam layer, the cuff pad 82 may be removed for laundry or for replacement where there are multiple users of the motion stilts 10.

The front portion of the dual straps 78 is attached by means of a buckle 84 (such as an Austrian buckle used in the military that has a 4000-pound breaking strength). The buckle 82 must have both ears (flanges of the opening device) depressed in order for the buckle to disengage.

The knee cuff axle connectors 56 retain the upper knee cuff 18 onto the Split Knee Bow™ system, which is unique to VELOCITY™ brand motion stilts, by preferably utilizing ¼-inch by 20 grade 8-rated bolts, as well as utilizing mechanical grade Teflon® bushings. A fender washer 86 of ¼-inch are used to connect the dual straps 78 to the leg braces 54, providing a greater surface area over which the forces are transmitted between the motion stilts 10 and the attachment location of the knee cuff 18.

Figure 3:
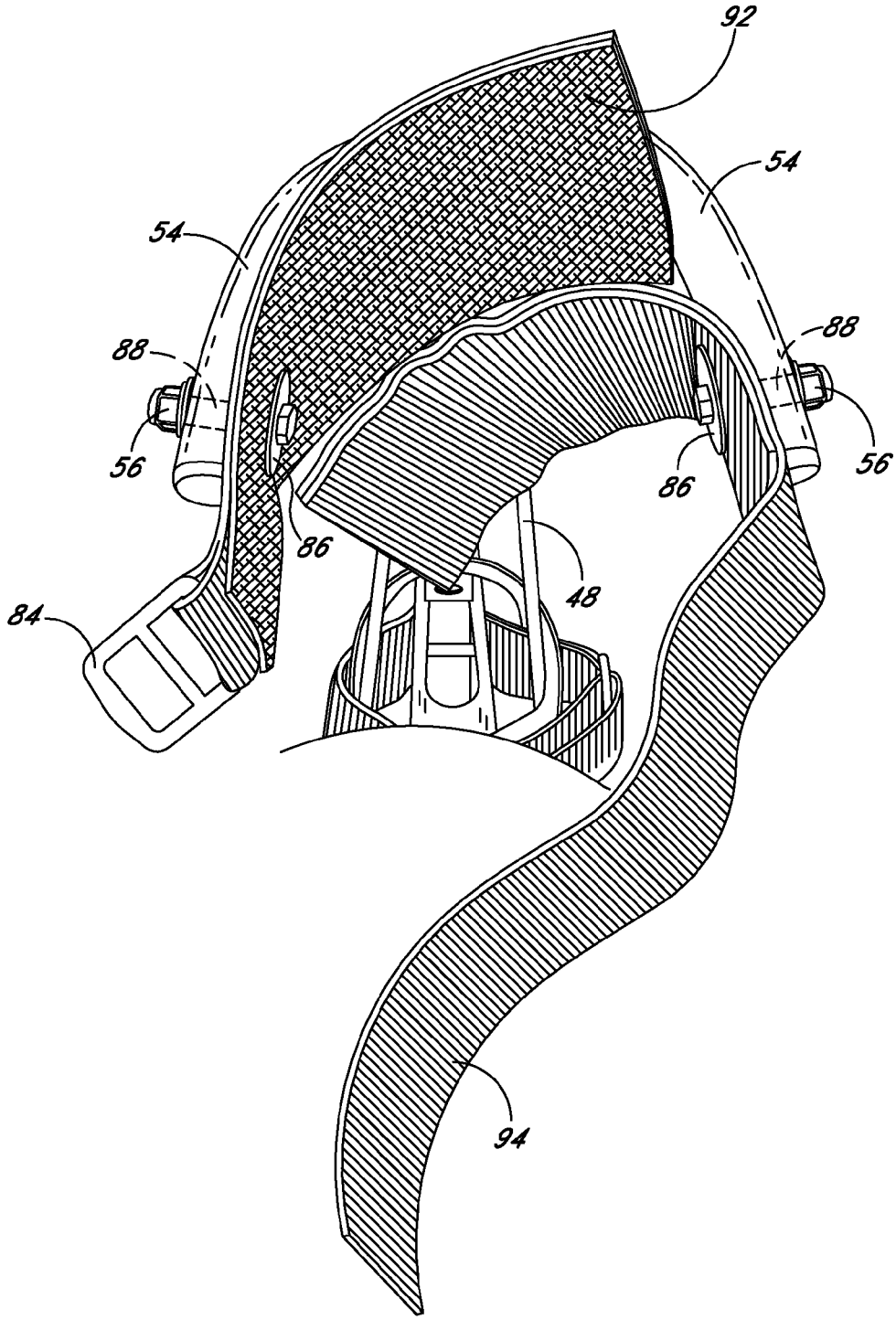
FIG. 3 is a partial perspective view, similar to FIG. 2, of a split knee bow belt attachment system in an opened configuration.

As is best shown in FIG. 3, a shank 88 of each of the bolts functions as an axle, permitting the knee cuff 18 to pivot about each of its connections to the leg braces 54. This pivoting action—also unique to the VELOCITY™ brand motion stilts, is another safety feature. The pivoting allows the knee cuff 18 to track the leg as opposed to forcing the kneecap into a standard position, with all of the give taken on or by the knee or by the surrounding area of the body.

The dual straps 78 are shown in FIG. 3 as consisting of an inner strap 92 and an outer strap 94—each attached to a separate knee cuff axle connector 56. The inner and outer straps 92, 94 are attached utilizing complementary surfaces of hook and loop fasteners in the rear portions as well as the knee cuff buckle 84 in the front. In a presently preferred embodiment a DELRIN® stiffener is inserted between the double strap layers, and is also preferably curvilinear in shape to maintain the dual straps in proper strap-configuration, resisting a tendency for the straps to turn over at the edges, gradually forming rope-like shapes.

Figure 4:
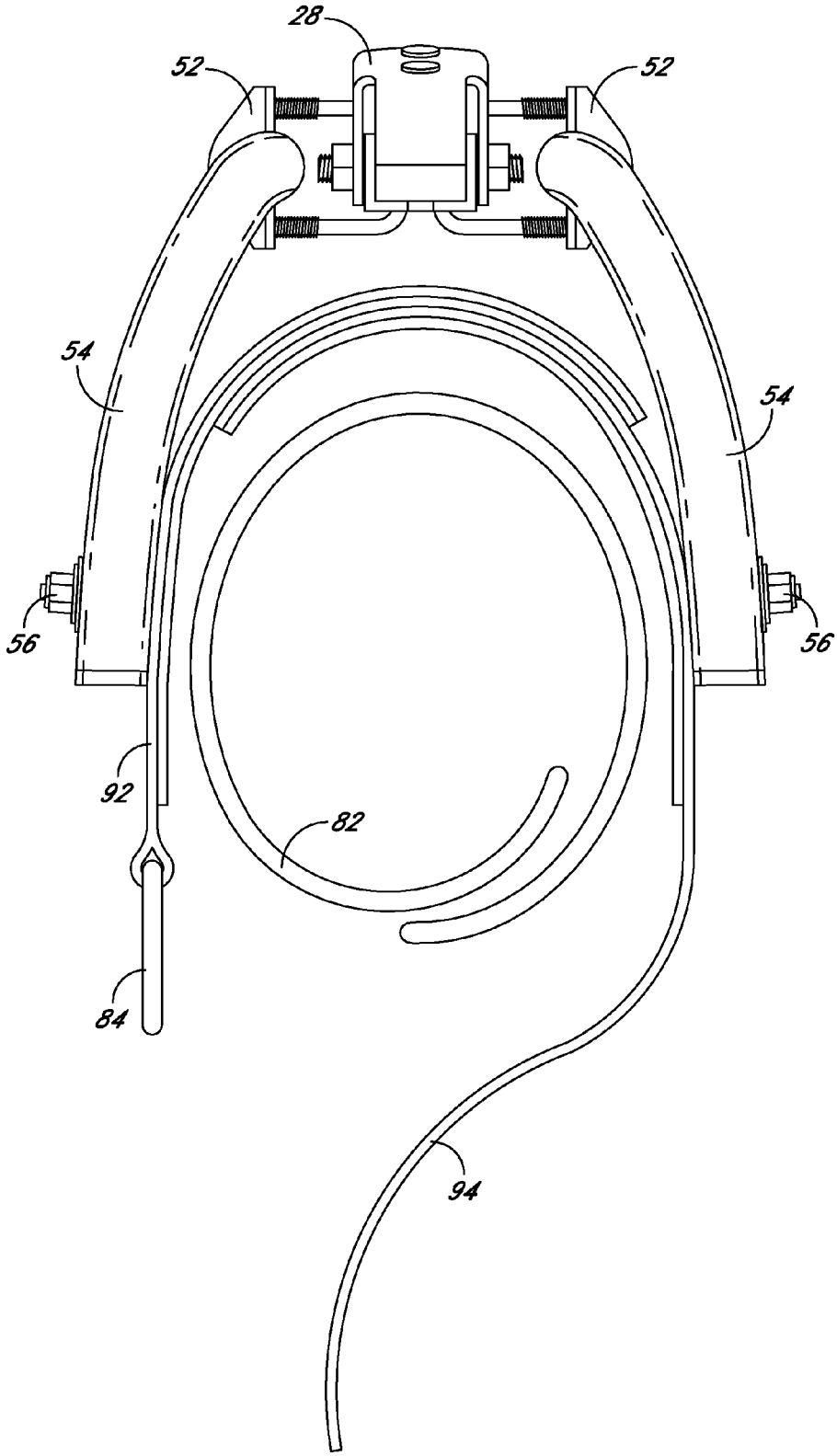
FIG. 4 is a top plan view of a split knee bow belt attachment system in a partially open configuration.

Turning to FIG. 4, the Split Knee Bow™ leg retention system, formed by the knee cuff 18 and the pair of leg braces 54, is adjustable utilizing the pair of leg brace brackets 52 for wider or narrower legs and calf muscles—this is also unique to the VELOCITY® brand motion stilts. As is also shown in FIG. 4, both the inner strap 92 and the outer strap 94 are provided a double-layer construction adjacent their connection to the respective leg braces 54 and along their length of inter-engagement with one another to form the rear of the knee cuff 18.

Figure 6:
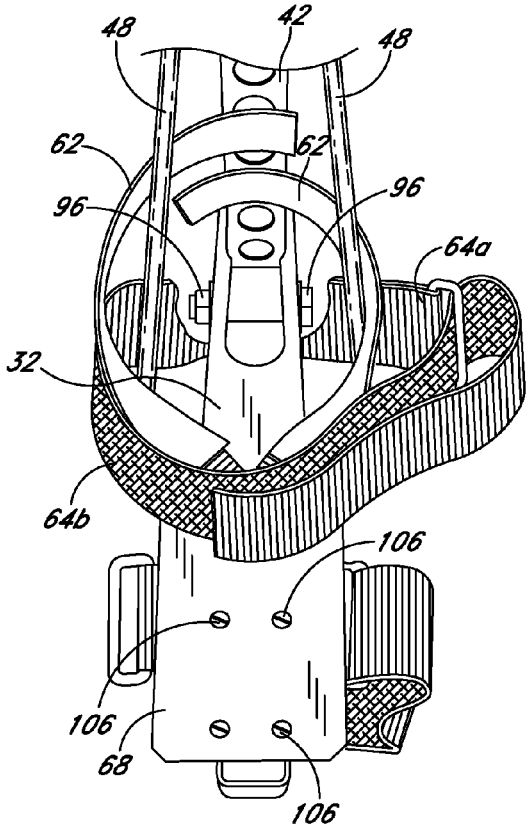
FIG. 6 is a partial perspective view, with portions broken away, of a foot strapping system in accordance with the present invention.

The lower strapping system for the motion stilts 10 consists of the three separate straps: the instep strap 64, the heel strap 62, and the toe strap 66. As is shown in FIG. 6 the instep strap 64 is a two-piece strap 64*a*, 64*b* retention system that is locked into place by Velcro® brand hook and loop fasteners—with complementary lengths of each formed on the separate straps 64*a*, 64*b* forming their cooperative attachment. One end of each of the instep straps 64*a*, 64*b* is attached to the foot plate utilizing a retaining bolt 96—preferably grade 8 bolts as well as Teflon® bushings to permit unrestrained rotation.

Figure 5:
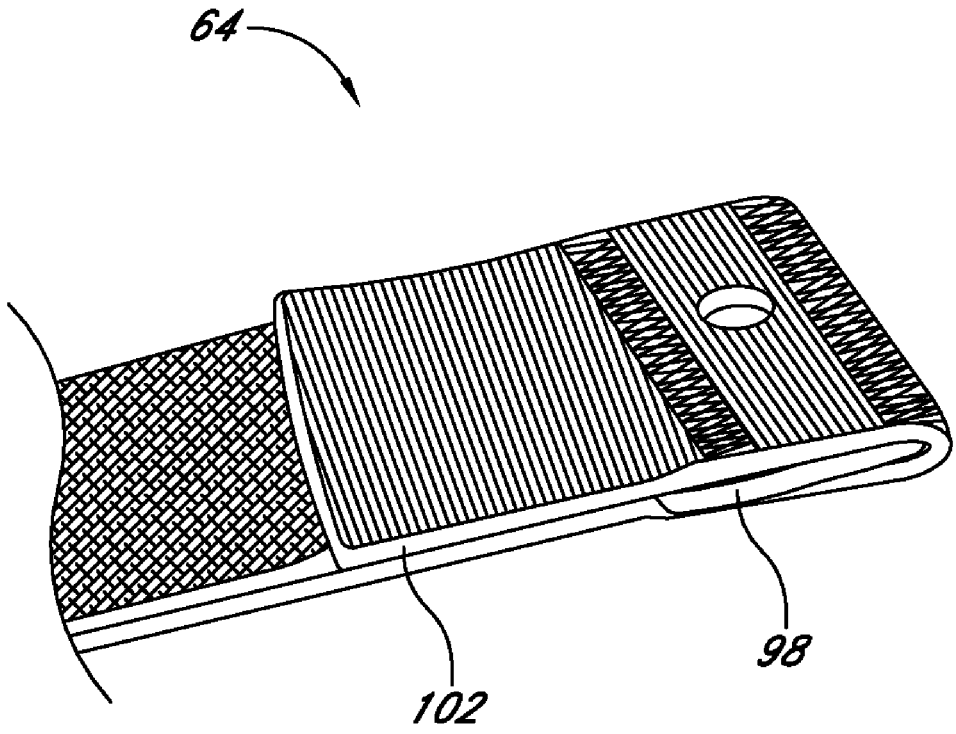
FIG. 5 is a partial perspective view of a reinforce belt end section.

The bolted ends of the instep straps 64*a*, 64*b* are preferably provided Spectra Shield® composite material 98 that is sewn into the folds of the military spec webbing to provide increased strength at this important connection (see FIG. 5). Spectra Shield® composite material is the strongest commercial-grade fabric in the world. The longer of the instep strap ends 102 has Velcro® sewn to the top, both hook and loop, and that piece is looped through a shorter end that has a stainless turn-around bar (not shown). After the longer end 102 turns around, it then utilizes the Velcro® fasteners to attach to itself on the loop end.

Returning again to FIG. 6, the heel straps 62 are cut to be attached beneath the toe support 68 so that weight, friction, and gravity all play a role in attachment strength, in addition to use of a foot plate retention bolt 106. The retention bolt 106 and associated nut get glued-on the threads when installed for further insurance that the ends of the heel straps 62 will not separate from the toe support 68 during use of the motion stilts 10. The back of the heel strap also has Velcro® for adjustability.

Figure 7:
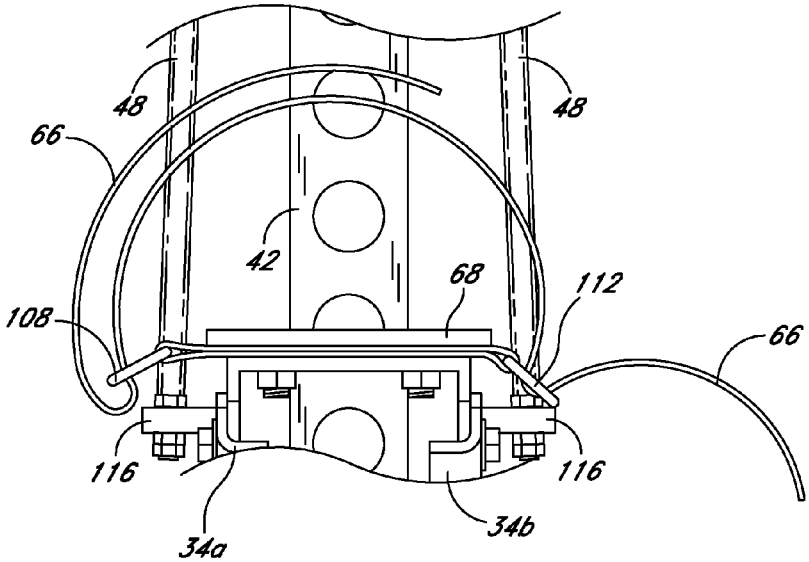
FIG. 7 is a partial side elevation view of a toe strap attachment system in accordance with the present invention.

The toe strap 66 is attached to the stilts beneath the toe support 68 for the same reasons of securement as was the case with the heel strap 62. The toe strap 66 has a turn-around bar 108 on one side and an adjustable, 2-pass buckle 112 on the other side for adjustability. Also shown in FIG. 7 is the leveling rod base 116, to which are attached the pair of leveling rods 48. In this manner the leveling rods 48 permit adjustability of the foot plate 32 through their attachment to and into the leveling rod base 116.

My invention has been disclosed in terms of a preferred embodiment thereof, which provides a motion stilts retention system that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A motion stilt comprising:

a spring support comprising:

a central spring having a first terminus and a second terminus, a lower spring capture attached to said central spring at said first terminus, and an upper spring capture attached to said central spring at said second terminus;

a knee cuff rotatably attached to said upper spring capture, wherein a pair of knee cuff axle connectors, one of said pair of knee cuff axle connectors on each side of said knee cuff, attach said knee cuff to said upper spring capture; and a foot plate having a heel and a toe end, said heel end of said foot plate attached to said upper spring capture and said toe end pivotally attached to said lower spring capture.

2. A motion stilt according to claim 1, and further comprising a pair of leg braces attached to said upper spring capture, wherein said knee cuff is rotatably received by and between said pair of leg braces.

3. A motion stilt according to claim 2, and further comprising a vertical upright attached to said heel end of said foot plate and extending to a location of attachment on said upper spring capture.

4. A motion stilt comprising:

a spring support comprising:

a central spring having a first terminus and a second terminus, a lower spring capture attached to said central spring at said first terminus, and an upper spring capture attached to said central spring at said second terminus;

a knee cuff rotatably attached to said upper spring capture;

a foot plate having a heel and a toe end, said heel end of said foot plate attached to said upper spring capture and said toe end pivotally attached to said lower spring capture; and a pair of leg braces attached to said upper spring capture, wherein said knee cuff is rotatably received by and between said pair of leg braces, and wherein said pair of leg braces are rotatably received by and attached to said vertical upright in a manner such that dimensional variance in a diameter of said knee cuff may be selectively obtained upon a cooperative rotation of said pair of leg braces.

5. A motion stilt comprising:

a spring support comprising:

a central spring having a first terminus and a second terminus, a lower spring capture attached to said central spring at said first terminus, and an upper spring capture attached to said central spring at said second terminus;

a knee cuff rotatably attached to said upper spring capture; and a foot plate having a heel and a toe end, said heel end of said foot plate attached to said upper spring capture and said toe end pivotally attached to said lower spring capture, wherein said knee cuff comprises an inner strap and an outer strap, said inner and outer straps selectively engaging along a first end segment of each, obtaining a substantially superposed attachment of said inner strap and said outer strap, and said inner and said outer straps selectively connecting to one another at a second end segment of each.

6. A motion stilt according to claim 5, and further comprising a knee cuff buckle attached to one of said inner and said outer straps at a second end segment thereof.

7. A motion stilt according to claim 6, and further comprising a pair of opposing surfaces of hook and loop fasteners, each attached to separate and adjacent superposed surfaces of said inner and outer straps along said first end segments thereof.

8. A motion stilt according to claim 7, and further comprising a pair of knee cuff axle connectors, each extending through a separate one of said pair of leg braces and rotatably attaching a separate one of said inner and outer straps thereto.

9. A motion stilt according to claim 8, and further comprising a cuff pad selectively receivable within and defining an inner circumference of said knee cuff.

10. A motion stilt according to claim 1, wherein a plurality of adjustable foot restraints are attached to said foot plate.

11. A motion stilt according to claim 10, wherein said plurality of adjustable foot restraints comprise a heel strap, an instep strap, and a toe strap.

12. A motion stilt according to claim 11, and further comprising a toe support attached to a top receiving surface of said foot plate at said toe end.

13. A motion stilt according to claim 12, wherein said heel strap comprises a selectively engagable first pair of straps, each of said first pair of straps attached to said foot plate at a location beneath and abutting said toe support and extending towards said heel end of said foot plate to a location for the selective engagement of said first pair of straps.

14. A motion stilt according to claim 13, wherein said instep strap comprises an interengagable second pair of straps, each of said second pair of straps separately attached to said foot plate at a location intermediate said heel and said toe ends and on opposed lateral sides of said foot plate.

15. A motion stilt according to claim 14, wherein said toe strap comprises a single strap and further comprising: a turn-around bar attached to said foot plate at a first lateral location adjacent said toe end; and an adjustable buckle attached to said foot plate at a second lateral location substantially opposite said first lateral location, said toe strap received by said turn-around bar and extending through said adjustable buckle.

* * * * *